United States Patent [19]

Bresson et al.

[11] Patent Number: 4,702,821

[45] Date of Patent: Oct. 27, 1987

[54] ORE FLOTATION AND DI-ALKALI METAL-DI(CARBOXYALKYL)DITHIOCARBAMATE AND DIAMMONIUM-DI(CARBOXYALKYL)DITHIOCARBAMATE FLOTATION AGENTS FOR USE THEREIN

[75] Inventors: Clarence R. Bresson; Harold W. Mark, both of Bartlesville, Okla.

[73] Assignee: Phillips Petroleum Company, Bartlesville, Okla.

[21] Appl. No.: 705,824

[22] Filed: Feb. 26, 1985

[51] Int. Cl.[4] ..... B05D 1/14

[52] U.S. Cl. ..... 209/166; 252/61; 558/238

[58] Field of Search ..... 260/455 A; 252/61; 209/166, 167; 558/238

[56] References Cited

U.S. PATENT DOCUMENTS

| | | | |
|---|---|---|---|
| 3,361,733 | 1/1968 | Okamura et al. | 260/455 A |
| 3,425,550 | 2/1969 | Baarson et al. | 209/166 |
| 3,464,551 | 9/1969 | Falvey | 209/166 |
| 4,514,293 | 4/1985 | Bresson et al. | 209/167 |

OTHER PUBLICATIONS

CA vol. 73, No. 20: 102423q, 1970.

*Primary Examiner*—Bernard Nozick

*Attorney, Agent, or Firm*—French & Doescher

[57] ABSTRACT

Carboxyalkyl dithiocarbamates which can be characterized by the formula

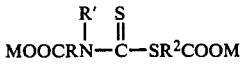

wherein R is selected from the group consisting of alkylene radicals, wherein R′ is selected from the group consisting of hydrogen and methyl and ethyl radicals, $R^2$ is selected from the group consisting of alkylene radicals and wherein M is selected from the group consisting of ammonium and alkali metal atoms, their use as ore flotation depressants, and a process for making these novel compositions are disclosed.

19 Claims, No Drawings

ORE FLOTATION AND DI-ALKALI METAL-DI(CARBOXYALKYL)DITHIOCARBAMATE AND DIAMMONIUM-DI(CARBOXYALKYL)DITHIOCARBAMATE FLOTATION AGENTS FOR USE THEREIN

This invention relates generally to novel chemical compositions. In one aspect, the invention relates to a process for making such compositions. In another aspect, the invention relates to ore flotation processes employing such novel compositions.

Froth flotation is a process for recovering and concentrating minerals from ores. In a froth flotation process, the ore is crushed and wet ground to obtain a pulp. Additives such as mineral flotation or collecting agents, frothing agents, suppressants or depresssants, stabilizers, etc., are added to the pulp to assist separating valuable minerals from the undesired or gangue portions of the ore in subsequent flotation steps. The pulp is then aerated to produce a froth at the surface. The minerals which adhere to the bubbles or froth are skimmed or otherwise removed and separated. The froth product or the reject product or both can then be further processed to obtain the desired minerals. Typical mineral flotation collectors include xanthates, amines, alkyl sulfates, arenes, sulfonates, dithiocarbamates, dithiophosphates, and thiols.

It is known from the art that some dithiocarbamates are useful as collecting agents. U.S. Pat. No. 3,464,551, for instance, describes dialkyl dithiocarbamates and the production thereof. U.S. Pat. No. 3,425,550 describes dialkyl dithiocarbamates and their production as well as the utility of these compounds as flotation collectors.

It is a continuing goal in the ore-processing industry to increase the productivity of ore flotation processes and, above all, to provide specific procedures which are selective to one ore or metal over other ores or metals present in the treated material.

It is an object of this invention to provide new dithiocarbamates.

A further object of this invention is to provide a process for making such dithiocarbamates.

Yet another object of this invention is to provide an ore flotation process wherein such new dithiocarbamates are used as flotation agents.

These and other objects, advantages, details, features and embodiments of this invention will become apparent to those skilled in the art from the following detailed description of the invention and the appended claims.

In accordance with this invention it has now been found that carboxyalkyl dithiocarbamate salts are very effective as suppressants in ore flotation processes.

Thus, in accordance with a first embodiment of this invention, novel compositions of matter are provided which can be characterized by the formula $$\mathrm{MOOCR(R')N-C(=S)-SR^2COOM} \qquad \text{(I)}$$

wherein R is selected from the group consisting of linear and branched alkylene radicals, preferably alkylene radicals each having from 1 to 12 carbon atoms and more preferably each having from 1 to 4 carbon atoms; wherein R′ is selected from the group consisting of hydrogen and methyl and ethyl radicals; wherein $R^2$ is selected from the group consisting of linear and branched alkylene radicals, preferably alkylene radicals each having from 1 to 12 carbon atoms and more preferably each having from 1 to 6 carbon atoms and wherein M is selected from the group consisting of ammonium and alkali metal atoms.

In accordance with a second embodiment of the invention there is provided a process for producing the above-defined novel dithiocarbamates. This process comprises reacting an aqueous hydroxide MOH, wherein M is selected from the group consisting of ammonium and alkali metal atoms including Li, Na, Rb, Cs and K, with an amino acid, preferably an amino acid characterized by the formula $$\mathrm{HOOCR(R')N-H,} \qquad \text{(II)}$$

wherein R is selected from the group consisting of linear and branched alkylene radicals, preferably alkylene radicals each having from 1 to 12 carbon atoms and more preferably each having from 1 to 4 carbon atoms, and wherein R′ is selected from the group consisting of hydrogen and methyl and ethyl radicals, and $CS_2$ to form a dithiocarbamate having the formula $$\mathrm{MOOCR(R')N-C(=S)-SM,} \qquad \text{(III)}$$

and thereafter reacting the product of formula (III) with an acid characterized by the formula $$\mathrm{XR^2COOH} \qquad \text{(IV),}$$

wherein $R^2$ is selected from the group consisting of linear and branched alkylene radicals, preferably alkylene radicals each having from 1 to 12 carbon atoms and more preferably each having from 1 to 6 carbon atoms; and wherein X is selected from the group consisting of chloro, bromo and iodo groups to form a dithiocarbamate having the formula (I); and recovering the product of formula (I) as the product of the process.

The amino acids useful to produce the novel dithiocarbamates of the present invention include, for example, but are not limited to such materials as glycine, α-alanine, β-alanine, α-aminoisovaleric acid, and the like.

The acids of formula (IV) useful to produce the novel dithiocarbamates of the present invention include, for example, but are not limited to such compositions as chloroacetic acid, bromoacetic acid, iodoacetic acid, 2-chloropropionic acid, 3-chloropropionic acid, 4-chlorobutanoic acid, 6-chlorohexanoic acid and the like.

The detailed operating conditions for the individual steps are not critical and specific values for the steps can be seen from the following examples.

The separation of the product of formula (I) is carried out by standard techniques.

A further embodiment of this invention resides in an ore flotation process. More specifically, such further embodiment of this invention resides in a process for separating valuable ore materials from gangue materials. The ore flotation process of this invention distinguishes over the known ore flotation processes primarily in the employment of a new flotation agent to be defined. Otherwise the recovery process involves crushing of the ore and ore grinding to obtain a pulp. In this pulp the flotation agent is incorporated and the pulp is aerated to produce a froth at the surface which is rich in valuable ore materials but depleted of the gangue materials or vice versa. The ore materials, optionally, after additional flotation and frothing steps, are recovered. Frothing agents, selective depressants and stabilizers which are well known in the art can be used in the various steps.

The dithiocarbamates useful in the ore flotation process of this invention are characterized by the formula $$\mathrm{MOOCR'N-\overset{\overset{\displaystyle S}{\|}}{C}-SR^2COOM} \qquad \text{(I)}$$

wherein R is selected from the group consisting of linear and branched alkylene radicals, preferably alkylene radicals each having from 1 to 12 carbon atoms and more preferably each having from 1 to 4 carbon atoms, R' is selected from the group consisting of hydrogen and methyl and ethyl radicals, $R^2$ is selected from the group consisting of linear and branched alkylene radicals, preferably alkylene radicals each having from 1 to 12 carbon atoms and more preferably each having from 1 to 6 carbon atoms and M is selected from the group consisting of ammonium and alkali metal atoms. Examples of such compounds useful as suppressants or depressants in the process of this invention are those generally characterized as diammonium N,S-di(carboxyalkyl)dithiocarbamates and di-alkali metal N,S-di(carboxyalkyl)dithiocarbamates, such as for example:

disodium N,S-bis(carboxymethyl)dithiocarbamate,
disodium N,S-bis(2-carboxyethyl)dithiocarbamate,
disodium N,S-bis(3-carboxypropyl)dithiocarbamate,
disodium N,S-bis(4-carboxybutyl)dithiocarbamate,
disodium (N-2-carboxyethyl) (S-carboxymethyl)dithiocarbamate,
disodium (N-carboxymethyl-N-methyl) (S-2-carboxyethyl)dithiocarbamate,
disodium (N-2-carboxyethyl-N-methyl) (S-carboxymethyl)dithiocarbamate,
disodium (N-3-carboxypropyl-N-methyl) (S-4-carboxybutyl)dithiocarbamate,
disodium (N-4-carboxybutyl-N-methyl) (S-6-carboxyhexyl)dithiocarbamate,
disodium (N-carboxymethyl-N-ethyl) (S-2-carboxyethyl)dithiocarbamate,
disodium (N-2-carboxyethyl-N-ethyl) (S-carboxymethyl)dithiocarbamate,
disodium (N-3-carboxypropyl-N-ethyl) (S-4-carboxybutyl)dithiocarbamate,
disodium (N-4-carboxybutyl-N-ethyl) (S-6-carboxyhexyl)dithiocarbamate,
dipotassium N,S-bis(carboxymethyl)dithiocarbamate,
dipotassium N,S-bis(2-carboxyethyl)dithiocarbamate,
dipotassium N,S-bis(3-carboxypropyl)dithiocarbamate,
dipotassium N,S-bis(4-carboxybutyl)dithiocarbamate,
dilithium N,S-bis(carboxymethyl)dithiocarbamate,
dilithium N,S-bis(2-carboxyethyl)dithiocarbamate,
dilithium N,S-bis(3-carboxypropyl)dithiocarbamate,
dilithium N,S-bis(4-carboxybutyl)dithiocarbamate,
diammonium N,S-bis(carboxymethyl) dithiocarbamate,
diammonium N,S-bis(2-carboxyethyl) dithiocarbamate,
diammonium N,S-bis(3-carboxypropyl) dithiocarbamate,
diammonium N,S-bis(4-carboxybutyl) dithiocarbamate and the like, and combinations of any two or more thereof.

It will be understood that the designation N,S in the nomenclature of various di(carboxyalkyl)dithiocarbamates and bis(carboxyalkyl)dithiocarbamates herein disclosed may be omitted for convenience, but it will be understood that the dithiocarbamates so disclosed are those having the N,S-substitution.

The presently preferred composition used as the ore flotation depressant in the process of this invention is disodium N,S-bis(carboxymethyl)dithiocarbamate.

The amount of di-alkali metal-di(carboxyalkyl)dithiocarbamate employed in the process of this invention is not critical. The quantity will depend upon whether it is being used with an ore or a concentrate and whether there is a large or small amount of mineral to be depressed. Generally, the amount of di-alkali metal-di(carboxyalkyl)dithiocarbamate employed in the process will be in the range of from about 0.1 lb to about 10 lb of the inventive depressant per ton of solids (lb/ton). Preferably the inventive ore flotation depressant will be used in a quantity in the range from about 0.15 to about 6 lb/ton of solids.

It is generally believed that the diammonium-di(carboxyalkyl)dithiocarbamates and di-alkali metal-di(carboxyalkyl)dithiocarbamates disclosed herein are useful for suppressing or depressing the flotation of certain metal sulfide minerals during ore flotation processes. It is also understood that the diammonium-di(carboxyalkyl)dithiocarbamates and di-alkali metal-di(carboxyalkyl)dithiocarbamates may suppress a mixture of metals or minerals that are contained in a particular mining deposit or ore, said mixture being further separated by subsequent froth flotations or any other conventional separating methods. The diammonium-di(carboxyalkyl)dithiocarbamates and di-alkali metal-di(carboxyalkyl) dithiocarbamates herein disclosed are particularly useful for depressing minerals based on copper, nickel, iron, lead and zinc from the total ore. Examples of such minerals include, but are not limited to such materials as Molybdenum-bearing ores:
Molybdenite: $MoS_2$
Wulfenite: $PbMoO_4$
Powellite: $Ca(Mo_1W)O_4$
Ferrimolybdite: $Fe_2MO_3O_{12}.8H_2O$
Copper-bearing ores:
Covellite: CuS
Chalcocite: $Cu_2S$
Chalcopyrite: $CuFeS_2$
Bornite: $Cu_5FeS_4$
Cubanite: $Cu_2SFe_4S_5$
Valerite: $Cu_2Fe_4S_7$ or $Cu_3Fe_4S_7$
Enargite: $Cu_3(As,Sb)S_4$
Tetrahedrite: $Cu_{12}Sb_4S_{13}$
Tennanite: $Cu_{12}As_4S_{13}$
Cuprite: $Cu_2O$
Tenorite: CuO
Malachite: $Cu_2(OH)_2CO_3$
Azurite: $Cu_3(OH)_2CO_3$
Antlerite: $Cu_3SO_4(OH)_4$
Brochantite: $Cu_4(OH)_6SO_4$
Atacamite: $Cu_2Cl(OH)_3$
Chrysocolla: $CuSiO_3$
Famatinite: $Cu_3(Sb,As)S_4$
Bournonite: $PbCuSbS_3$ Lead-Bearing ore:
Galena: PbS
Zinc-Bearing ores:
Sphalerite: ZnS
Zincite: ZnO
Smithsonite: $ZnCO_3$
Chromium-Bearing ores:
Daubreelite: $FeSCrS_3$
Chromite: $FeO.Cr_2O_3$
Iron-Bearing ores:
Pyrite: $FeS_2$
Marcasite: $FeS_2$
Pyrrhotite: $Fe_7S_8$
Nickel-Bearing ores:
Pentlandite: (FeNi)S
Millerite: NiS
Niccolite: NiAs The presently preferred ores in connection with which the process of this invention is applied are molybdenum, copper, lead, nickel and iron ores or minerals.

SEPARATION CONDITIONS

Any froth flotation apparatus can be used in this invention. The most commonly used commercial flotation machines are the Agitar (Galigher Co.), Denver Sub-A (Denver Equipment Co.), and the Fagergren (Western Machinery Co.). Smaller laboratory scale apparatus such as the Hallimond cell can also be used.

The instant invention was demonstrated in tests conducted at ambient room temperature to about 37° C. (100° F.) and atmospheric pressure. However, any temperature or pressure generally employed by those skilled in the art is within the scope of this invention.

The following examples serve to illustrate this invention without undue limitation of the scope thereof.

EXAMPLE I

The example describes the preparation of a di-alkali metal-di(carboxyalkyl)dithiocarbamate composition in the form of disodium N,S-bis(carboxymethyl)dithiocarbamate, a novel compound. To a one liter 3-neck flask fitted with a stirrer, reflux condenser, thermometer, dropping funnel and heating mantle was added 161 milliliters of water and 126 grams (3.15 moles) of solid sodium hydroxide. After the sodium hydroxide had dissolved and the temperature subsided below about 30° C. there was slowly added 75 grams (1.0 mole) of glycine. To this stirred mixture was then added 76.1 grams (1.0 mole) of carbon disulfide and the mixture heated to reflux for about 8 hours until all of the carbon disulfide had completely reacted. The mixture was cooled while 211 milliliters of additional water was added to the mixture. After cooling below about 40° C. there was slowly added 94.5 grams (1.0 mole) of chloroacetic acid dissolved in 100 milliliters of water. The addition resulted in an exotherm and about half way through the addition solids began to form. Another 168 milliliters of water was added to keep all the salts in solution. The reaction product mixture at this point was considered to be a 25 weight percent aqueous solution of disodium N,S-bis(carboxymethyl)dithiocarbamate.

EXAMPLE II

This example describes the procedure used to evaluate the reaction product mixture prepared in Example I as a depressant in a Mo ore flotation wherein Cu and Fe sulfide minerals are suppressed while Mo continues to be floated. About 1000 grams of a Mo/Cu/Fe-containing ore (Moly Corp. Questa Mine) along with 660 milliliters of water, 0.1 milliliters (0.2 lb/ton) diesel oil (Mo collector) and 14 drops (0.1 lb/ton) frother (6:3 weight ratio of methyl isobutylcarbinol:pine oil) were ground in a table ball mill for 6 minutes 42 seconds and transferred to a 2.5 liter capacity Wemco flotation cell, conditioned 30 seconds at 1500 rpm and floated for 8 minutes. The concentrate produced at this point is referred to as the rougher concentrate. The rougher concentrate was transferred to a 1.6 liter capacity Denver flotation cell along with enough water to bring the level of slurry to within 1 or 2 inches of the cell lip. To the cell was added 0.93 milliliters (5 lbs/ton) of the inventive depressant along with enough lime to maintain a pH of 8.5. The slurry was conditioned for 2 minutes at 1100 rpm whereupon 1 drop (about 0.007 lb/ton) diesel oil (Mo collector) and 2 drops (about 0.014 lb/ton) frother was further added. The slurry was conditioned for 30 seconds and floated for 4 minutes. This second float, referred to as the cleaner concentrate, was filtered, dried and analyzed. The procedure was repeated and an average weight percent recovery estimated based on the amount of Mo, Cu and Fe present in the rougher concentrate. In this manner there was obtained average weight percent recoveries of 69.0 percent Mo, 7.5 percent Cu, and 4.8 percent Fe.

The procedure was then repeated several times using a known commercial depressant (runs 3 and 4) and a control where no depressant was added (runs 1 and 2). These results are listed in Table I where it can be seen that the inventive disodium N,S-bis(carboxymethyl)dithiocarbamate (runs 5 and 6) depresses the flotation of Cu and Fe while not greatly interfering with the flotation of Mo when compared with runs 1 and 2 where no depressant was employed. The data indicate that the Cu and Fe depression is not quite as good as with the control depressant (runs 3 and 4) but the percent recovery of Mo is significantly higher which shows that the inventive depressant acts very well as a selective depressant of Cu and Fe relative to Mo.

TABLE I

Disodium—N,S—Bis(Carboxymethyl)Dithiocarbamate as a Mineral Depressant in Ore Flotation

| Run | Depressant, 5 lb/T solids | | Wt. % Recovery Mo | Cu | Fe |
|---|---|---|---|---|---|
| Control: | | | | | |
| 1 | No additive | | 78.5 | 70.3 | 12.7 |
| 2 | No additive | | 75.8 | 62.0 | 6.4 |
| | | Av. = | 77.2 | 66.2 | 9.6 |
| 3 | $Na_2$—Carboxymethyl Trithiocarbonate[a] | | 48.5 | 4.7 | 3.3 |
| 4. | $Na_2$—Carboxymethyl Trithiocarbonate[a] | | 51.3 | 6.2 | 2.5 |
| | | Av. = | 49.9 | 5.5 | 2.9 |
| Invention: | | | | | |
| 5 | $Na_2$—N,S—Bis(carboxymethyl)-Dithiocarbamate[b] | | 63.0 | 5.4 | 3.9 |
| 6 | $Na_2$—N,S—Bis(carboxymethyl)-Dithiocarbamate[b] | | 75.0 | 9.5 | 5.6 |
| | | Av. = | 69.0 | 7.5 | 4.8 |

[a] $NaOOCCH_2-S-\overset{\overset{\displaystyle S}{\|}}{C}-S-Na$, 40% aq. sol'n

[b] $NaOOCCH_2\overset{\overset{\displaystyle H}{|}}{N}-\overset{\overset{\displaystyle S}{\|}}{C}-S-CH_2COONa$

EXAMPLE III

This example describes the procedure used for further evaluation of the reaction product mixture prepared in Example I as a depressant in a Mo flotation process wherein Cu, Pb and Fe sulfide minerals are depressed while Mo continues to be floated. About 1000 grams of a Mo/Cu/Pb/Fe-containing ore (Moly Corp. Questa Mine) along with 660 milliliters of water, 0.1 milliliter (0.2 lb/ton) diesel oil (Mo collector) and 14 drops (0.1 lb/ton) frother (6:3 weight ratio of methyl isobutylcarbinol:pine oil) were ground in a table ball mill for 6 minutes 42 seconds and transferred to a 2.5 liter capacity Wemco flotation cell, conditioned about 30 seconds at 1500 rpm and floated for about 8 minutes. The concentrate produced at this point is referred to as the rougher concentrate. The rougher concentrate was transferred to a 1.6 liter capacity Denver D-12 flotation cell along with enough water to bring the level of slurry to within 1 or 2 inches of the cell lip. In each of the runs 7–14 a quantity of depressant was added to the cell with sufficient aqueous NaOH to maintain a pH of about 8.5 and the slurry was conditioned for 2 minutes at 1100 rpm whereupon 1 drop (about 0.007 lb/ton) diesel oil (Mo collector) and 2 drops (about 0.014 lb/ton) frother was further added. The slurry was conditioned for 30 seconds and floated for 4 minutes. This second float produced a cleaner concentrate which was filtered, dried and analyzed. In each run the weight percent recovery of Mo, Cu, Pb and Fe was calculated based on the corresponding amounts of Mo, Cu, Pb and Fe present in the rougher concentrate. The average weight percent recovery for the two runs for each depressant dosage were also calculated. These results are listed in Table II where it can be seen that the inventive disodium N,S-bis(carboxymethyl)dithiocarbamate selectively depresses the flotation of Cu, Pb and Fe (runs 9–14) while substantially maintaining the flotation of Mo when compared with control runs 7 and 8 where sodium 2-hydroxyethyl trithiocarbamate was employed. It is significant to note that the average weight percent recovery of Mo at an inventive depressant dosage of 0.4 lb/ton solids (runs 9 and 10) and at a depressant dosage of 0.8 lb/ton solids (runs 11 and 12) was actually slightly increased over the average weight percent recovery of Mo in control runs 7 and 8 employing sodium 2-hydroxyethyl trithiocarbamate depressant.

TABLE II

Disodium N,N—Bis(Carboxymethyl) Dithiocarbamate as a Mineral Depressant in Ore Flotation

| | | Depressant Dosage | | Wt. % Recovery | | | |
|---|---|---|---|---|---|---|---|
| Run | Depressant | ml | lb/ton solids | Mo | Cu | Pb | Fe |
| Control: | | | | | | | |
| 7 | HETTC[a] | 4 | 1.6 | 85.5 | 72.8 | 59.6 | 12.0 |
| 8 | HETTC | 4 | 1.6 | 85.2 | 77.6 | 63.2 | 14.7 |
| Avg. | | | | 85.4 | 75.2 | 61.4 | 13.4 |
| Invention: | | | | | | | |
| 9 | TNNBD[b] | 1 | 0.4 | 86.6 | 9.4 | 33.4 | 8.06 |
| 10 | [b] | 1 | 0.4 | 87.6 | 12.0 | 34.5 | 8.69 |
| Avg. | | | | 87.1 | 10.7 | 34.0 | 8.38 |
| 11 | [b] | 2 | 0.8 | 86.7 | 8.92 | 27.8 | 8.51 |
| 12 | [b] | 2 | 0.8 | 87.6 | 24.4 | 29.8 | 9.75 |
| Avg. | | | | 87.2 | 16.7 | 28.8 | 9.13 |
| 13 | [b] | 4 | 1.6 | 83.9 | 6.91 | 24.9 | 6.14 |
| 14 | [b] | 4 | 1.6 | 83.9 | 9.83 | 26.0 | 6.51 |
| Avg. | | | | 83.9 | 8.37 | 25.5 | 6.33 |

[a]Sodium 2-hydroxyethyl trithiocarbamate
[b]Disodium N,S—bis(carboxymethyl) dithiocarbamate In summary, the data herein disclosed reveal that the novel di-alkali metal-di(carboxyalkyl) dithiocarbamates of the present invention are useful as depressants in ore flotation processes. The novel compounds are shown to be particularly suited for suppressing Cu, Fe, and Pb in the flotation of Mo.

Reasonable variations and modifications which will become apparent to those skilled in the art can be made in this invention without departing from the spirit and scope thereof.

We claim:

1. The composition represented by the formula $$\mathrm{MOOCR'N}-\overset{\overset{\displaystyle S}{\|}}{C}-\mathrm{SR^2COOM} \qquad \text{(I)}$$

wherein R is selected from the group consisting of alkylene radicals; wherein R′ is selected from the group consisting of hydrogen and methyl and ethyl radicals; wherein $R^2$ is selected from the group consisting of alkylene radicals; and wherein M is selected from the group consisting of ammonium and alkali metal atoms.

2. A composition in accordance with claim 1 wherein M is a sodium atom.

3. A composition in accordance with claim 1 wherein R is selected from the group consisting of alkylene radicals each having from 1 to 12 carbon atoms and $R^2$ is selected from the group consisting of alkylene radicals each having from 1 to 12 carbon atoms.

4. A composition in accordance with claim 3 wherein R is selected from the group consisting of alkylene radicals each having from 1 to 4 carbon atoms and $R^2$ is selected from the group consisting of alkylene radicals each having from 1 to 6 carbon atoms.

5. Di-alkali metal N,S-di(carboxyalkyl)dithiocarbamate.

6. Di-alkali metal N,S-di(carboxyalkyl)dithiocarbamate in accordance with claim 5 wherein each alkylene radical has from 1 to 12 carbon atoms.

7. Di-alkali metal N,S-di(carboxyalkyl)dithiocarbamate in accordance with claim 5 wherein each alkylene radical has from 1 to 4 carbon atoms.

8. A composition in accordance with claim 5 wherein said di-alkali metal N,S-di(carboxyalkyl)dithiocarbamate is selected from the group consisting of:

disodium N,S-bis(carboxymethyl)dithiocarbamate,
disodium N,S-bis(2-carboxyethyl)dithiocarbamate,
disodium N,S-bis(3-carboxypropyl)dithiocarbamate,
disodium N,S-bis(4-carboxybutyl)dithiocarbamate,
disodium (N-2-carboxyethyl) (S-carboxymethyl)dithiocarbamate,
disodium (N-carboxymethyl-N-methyl) (S-2-carboxyethyl)dithiocarbamate,
disodium (N-2-carboxyethyl-N-methyl) (S-carboxymethyl)dithiocarbamate,
disodium (N-3-carboxypropyl-N-methyl) (S-4-carboxybutyl)dithiocarbamate,
disodium (N-4-carboxybutyl-N-methyl) (S-6-carboxyhexyl)dithiocarbamate,
disodium (N-carboxymethyl-N-ethyl) (S-2-carboxyethyl)dithiocarbamate,
disodium (N-2-carboxyethyl-N-ethyl) (S-carboxymethyl)dithiocarbamate,
disodium (N-3-carboxypropyl-N-ethyl) (S-4-carboxybutyl)dithiocarbamate,
disodium (N-4-carboxybutyl-N-ethyl) (S-6-carboxyhexyl)dithiocarbamate,
dipotassium N,S-bis(carboxymethyl)dithiocarbamate, dipotassium N,S-bis(2-carboxyethyl)dithiocarbamate, dipotassium N,S-bis(3-carboxypropyl)dithiocarbamate, dipotassium N,S-bis(4-carboxybutyl)dithiocarbamate, dilithium N,S-bis(carboxymethyl)dithiocarbamate, dilithium N,S-bis(2-carboxyethyl)dithiocarbamate, dilithium N,S-bis(3-carboxypropyl)dithiocarbamate, dilithium N,S-bis(4-carboxybutyl)dithiocarbamate, and combinations of any two or more thereof.

9. Disodium N,S-di(carboxyalkyl)dithiocarbamate.

10. Disodium N,S-bis(carboxymethyl)dithiocarbamate.

11. Disodium N,S-bis(2-carboxyethyl)dithiocarbamate.

12. Diammonium N,S-di(carboxyalkyl)dithiocarbamate.

13. Diammonium N,S-di(carboxyalkyl)dithiocarbamate in accordance with claim 12 wherein each alkylene radical has from 1 to 12 carbon atoms.

14. Diammonium N,S-di(carboxyalkyl)dithiocarbamate in accordance with claim 12 wherein each alkylene radical has from 1 to 4 carbon atoms.

15. A composition in accordance with this claim 12 wherein said diammonium N,S-di(carboxyalkyl)dithiocarbamate is selected from the group consisting of: diammonium N,S-bis(carboxymethyl) dithiocarbamate, diammonium N,S-bis(2-carboxyethyl) dithiocarbamate, diammonium N,S-bis(3-carboxypropyl) dithiocarbamate, diammonium N,S-bis(4-carboxybutyl) dithiocarbamate, and combinations of any two or more thereof.

16. A process for recovering minerals comprising:

(a) mixing crushed ore containing minerals comprising molybdenum and at least one metal selected from the group consisting of copper, iron and lead, with water, and a dithiocarbamate having the formula

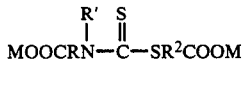

wherein R is selected from the group consisting of alkylene radicals, wherein R′ is selected from the group consisting of hydrogen and methyl and ethyl radicals, $R^2$ is selected from the group consisting of alkylene radicals and wherein M is selected from the group consisting of ammonium and alkali metal atoms, to establish a pulp;

(b) aerating said thus established pulp to produce a froth containing a first portion of said minerals comprising molybdenum while allowing a second portion of said minerals comprising at least one element selected from the group consisting of copper, iron and lead to be suppressed in said pulp; and (c) recovering said first portion of said minerals comprising molybdenum from said thus produced froth and recovering said thus suppressed minerals from said pulp.

17. A process in accordance with claim 16 wherein R is selected from the group consisting of alkylene radicals each having from 1 to 12 carbon atoms and $R^2$ is selected from the group consisting of alkylene radicals each having from 1 to 12 carbon atoms.

18. A process in accordance with claim 16 wherein M is sodium.

19. A process for recovering minerals comprising:

(a) producing a dithiocarbamate having the formula

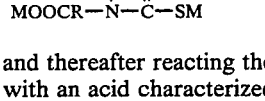

(I)

wherein R is selected from the group consisting of alkylene radicals, wherein R′ is selected from the group consisting of hydrogen and methyl and ethyl radicals, wherein $R^2$ is selected from the group consisting of alkylene radicals, and wherein M is selected from the group consisting of ammonium and alkali metal atoms, comprising reacting a hydroxide selected from the group consisting of ammonium hydroxide and alkali metal hydroxides and combinations of any two or more thereof with an amino acid and $CS_2$ to form a dithiocarbamate having the formula

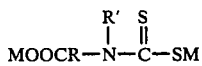

(II)

and thereafter reacting the product of formula (II) with an acid characterized by the formula $$XR^2COOH \qquad \text{(III)}$$

wherein $R^2$ is selected from the group consisting of alkylene radicals and wherein X is selected from the group consisting of chloro, bromo and iodo groups to form a dithiocarbamate having the formula (I), and recovering a dithiocarbamate having the formula (I) as the product of the process;

(b) mixing crushed ore containing minerals comprising molybdenum and at least one metal selected from the group consisting of copper, iron and lead, with water, and a composition produced in accordance with step (a) to establish a pulp;

(c) aerating said thus established pulp to produce a froth containing a first portion of said minerals comprising molybdenum while allowing a second portion of said minerals comprising at least one metal selected from the group consisting of copper, iron and lead to be suppressed in said pulp; and (d) recovering said first portion of said minerals comprising molybdenum from said thus produced froth and recovering said thus suppressed minerals from said pulp.

* * * * *